US010033118B2

(12) United States Patent
Jager et al.

(10) Patent No.: US 10,033,118 B2
(45) Date of Patent: Jul. 24, 2018

(54) ARRANGEMENT FOR AN ELECTRICAL CONNECTOR

(71) Applicant: TE Connectivity Germany GmbH, Bensheim (DE)

(72) Inventors: Stefan Jager, Rodgau (DE); Markus Strelow, Morlenbach (DE); Ralf Schmidt, Furth (DE); Ingon Kang, Darmstadt (DE); Christian Schrettlinger, Bensheim-Auerbach (DE); Matthias Haucke, Clingen (DE); Martin Szelag, Bickenbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/161,434

(22) Filed: May 23, 2016

(65) Prior Publication Data

US 2016/0268703 A1 Sep. 15, 2016

Related U.S. Application Data

(63) Continuation of application No. PCT/EP2014/075307, filed on Nov. 21, 2014.

(30) Foreign Application Priority Data

Nov. 25, 2013 (DE) ..... 10 2013 224 042

(51) Int. Cl.
*H01R 4/24* (2018.01)
*H01R 4/2433* (2018.01)
(Continued)

(52) U.S. Cl.
CPC ..... *H01R 4/2433* (2013.01); *H01R 4/2454* (2013.01); *H01R 13/516* (2013.01);
(Continued)

(58) Field of Classification Search
CPC .. H01R 4/2429; H01R 4/2433; H01R 9/0757; H01R 4/2466; H01R 4/2412; H01R 23/025; H01R 23/005
(Continued)

(56) References Cited

U.S. PATENT DOCUMENTS 2,534,881 A * 12/1950 Schroeder ..... H01R 4/2412 174/84 S
2,673,968 A 3/1954 Smith
(Continued)

FOREIGN PATENT DOCUMENTS

BE 1015495 A3 5/2005
DE 29040226 A1 4/1980
(Continued)

OTHER PUBLICATIONS

Translation of Chinese First Office Action, dated May 26, 2016, 16 pages.
(Continued)

*Primary Examiner* — Thanh Tam Le
(74) *Attorney, Agent, or Firm* — Barley Snyder

(57) ABSTRACT

An arrangement for an electrical connector is disclosed. The arrangement has a first connector portion and a second connector portion which can be folded relative to each other, the first connector portion having an insulation displacement contact and the second connector portion having a cable pressing face facing the insulation displacement contact, and a fitting sleeve having inner faces fitting over the first and second connector portions in a fitting direction, the inner faces extending towards each other counter to the fitting direction.

20 Claims, 11 Drawing Sheets

(51) Int. Cl.

| | |
|---|---|
| ***H01R 4/2454*** | (2018.01) |
| ***H01R 13/516*** | (2006.01) |
| ***H01R 24/64*** | (2011.01) |
| *H01R 13/6581* | (2011.01) |
| *H01R 107/00* | (2006.01) |

(52) U.S. Cl.
CPC ..... *H01R 24/64* (2013.01); *H01R 13/6581* (2013.01); *H01R 2107/00* (2013.01)

(58) Field of Classification Search
USPC ..... 439/395, 404, 405, 407, 409, 410, 417, 439/418, 676, 941
See application file for complete search history.

(56) References Cited

U.S. PATENT DOCUMENTS

| | | | | |
|---|---|---|---|---|
| 3,576,518 | A * | 4/1971 | Bazille, Jr. | H01R 4/2433 439/402 |
| 4,726,785 | A * | 2/1988 | Kerboul | H01R 4/22 439/417 |
| 4,822,298 | A * | 4/1989 | Gerke | H01R 4/2445 439/402 |
| 5,174,783 | A * | 12/1992 | Stassen | H01R 12/675 439/410 |
| 5,305,547 | A * | 4/1994 | Weiss | H01R 4/2433 439/395 |
| 5,439,388 | A * | 8/1995 | Weiss | H01R 13/59 439/417 |
| 5,957,720 | A * | 9/1999 | Boudin | H01R 24/64 439/409 |
| 6,074,238 | A * | 6/2000 | DeRoss | H01R 12/675 439/409 |
| 6,682,363 | B1 | 1/2004 | Chang | |
| 7,066,764 | B2 * | 6/2006 | Bolouri-Saransar | H01R 4/2433 439/409 |
| 7,140,905 | B2 * | 11/2006 | Castaldo | H01R 13/5833 439/395 |
| 7,379,713 | B2 | 5/2008 | Lindstedt | |
| 7,559,790 | B2 * | 7/2009 | Boeck | H01R 24/64 439/409 |
| 7,713,081 | B2 * | 5/2010 | Chen | H01R 9/037 439/409 |
| 7,918,684 | B2 * | 4/2011 | Lu | H01R 4/2433 439/395 |
| 8,192,224 | B2 * | 6/2012 | Schmidt | H01R 24/64 439/409 |
| 8,215,980 | B1 * | 7/2012 | Lin | H01R 4/2433 439/404 |
| 8,320,724 | B2 | 11/2012 | Sasaoka | |
| 8,573,999 | B2 * | 11/2013 | Feldner | H01R 4/2429 439/409 |
| 2009/0157937 | A1 | 6/2009 | Kuschke et al. | |
| 2013/0280962 | A1 | 10/2013 | Fransen | |

FOREIGN PATENT DOCUMENTS

| | | | |
|---|---|---|---|
| DE | 10 2007 008 465 | A1 | 8/2008 |
| EP | 0907221 | A2 | 4/1999 |
| EP | 1693934 | A1 | 8/2006 |

OTHER PUBLICATIONS

German Office Action, dated Oct. 15, 2014, 6 pages.
PCT Notification, International Search Report and Written Opinion, Intl Application No. PCT/EP2014/075307, dated Mar. 17, 2015, 12 pages.
The First Office Action and English translation, dated Jun. 26, 2017, 18 pages.

* cited by examiner

ARRANGEMENT FOR AN ELECTRICAL CONNECTOR

CROSS-REFERENCE TO RELATED APPLICATIONS

This application is a continuation of PCT International Patent Application No. PCT/EP2014/075307, filed on Nov. 21, 2014, which claims priority under 35 U.S.C. § 119 to German Patent Application No. 102013224042.2, filed on Nov. 25, 2013.

FIELD OF THE INVENTION

The present invention relates to an arrangement for an electrical connector, and more particularly, to an arrangement for an electrical connector capable of being fitted to a cable.

BACKGROUND

Electrical connectors are commonly fitted to cables. For example, as is known in the art, simple assembly on a cable can be carried out by means of an insulation displacement contact which cuts an insulation of the cable and contacts the internal conductor. Such an insulation displacement contact may be arranged, for instance, on a first portion of a connector and be pressed perpendicularly relative to the cable direction onto a second portion which retains the cable. In another known embodiment, a first portion having an insulation displacement contact is folded onto a second portion retaining the cable. The aforementioned systems, however, require a relatively large force to be applied; thus, manual assembly of the electrical connector and cable is not possible.

SUMMARY

An object of the invention, among others, is to provide an arrangement for an electrical connector permitting manual assembly. The disclosed arrangement has a first connector portion and a second connector portion which can be folded relative to each other, the first connector portion having an insulation displacement contact and the second connector portion having a cable pressing face facing the insulation displacement contact, and a fitting sleeve having inner faces fitting over the first and second connector portions in a fitting direction, the inner faces extending towards each other counter to the fitting direction.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an arrangement for an electrical connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 6:
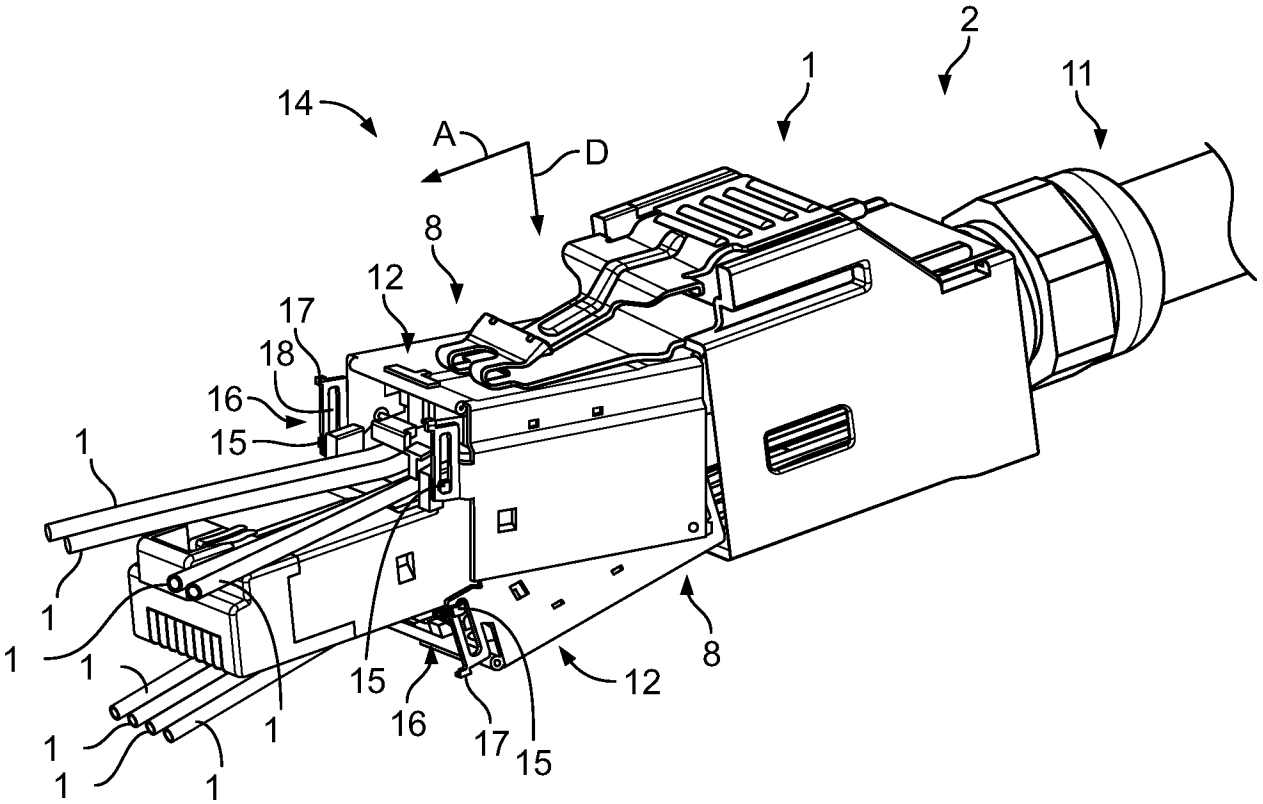
FIG. 6 is a perspective view of the arrangement of FIG. 3 in a fourth assembly step.

An arrangement 14 for or in an electrical connector 20 is generally shown in FIG. 6. The arrangement 14 includes a fitting sleeve 1, a plurality of connector portions 8, and a cable 11. The major components of the invention will now be described in greater detail.

Figure 1:
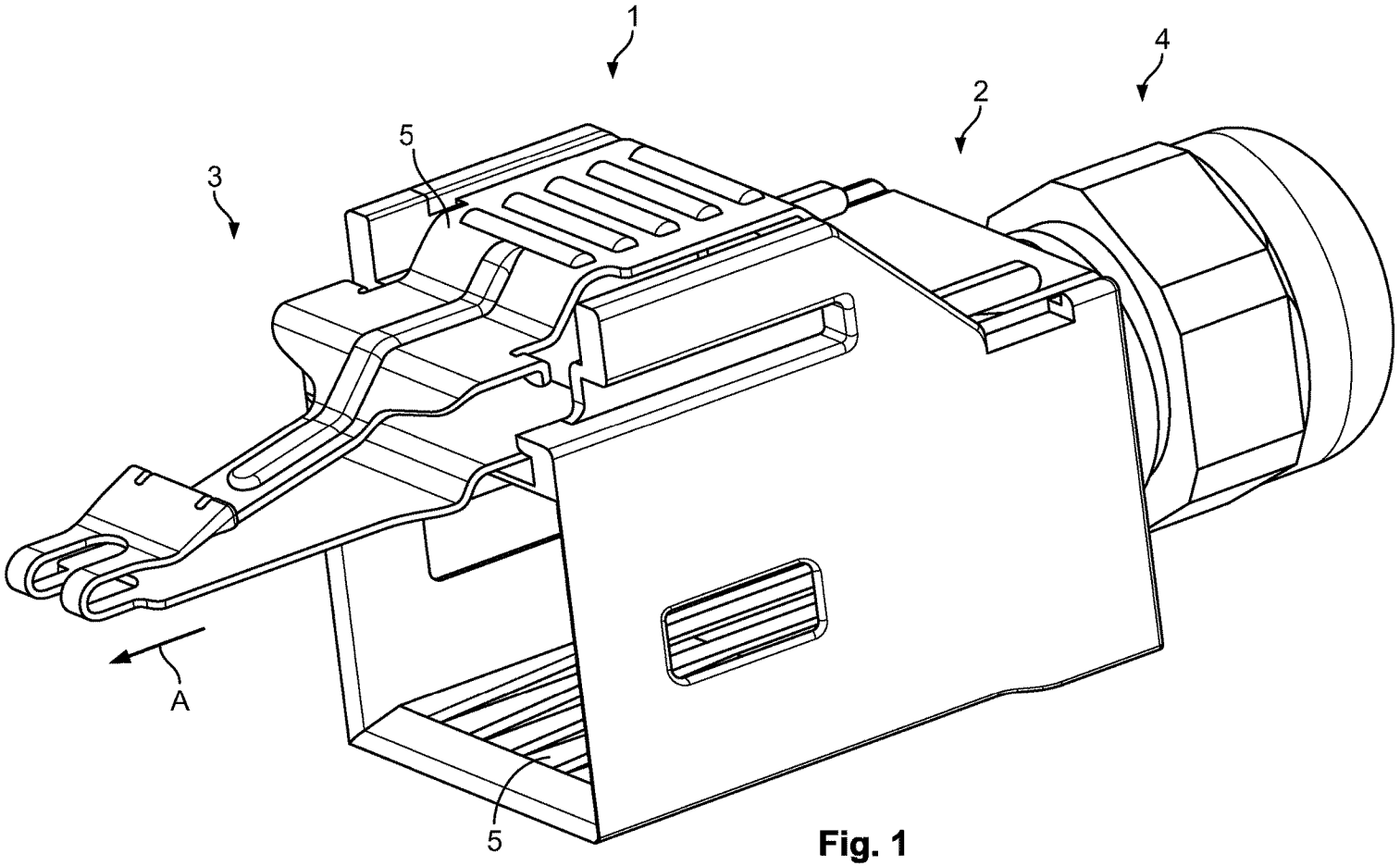
FIG. 1 is a perspective view of a fitting sleeve according to the invention.

Fitting sleeve 1 is shown in FIG. 1. The fitting sleeve 1 comprises primarily an injection-moulded component which is produced from a thermoplastic plastics material. The fitting sleeve 1 may alternatively be formed from a metal sheet by a punching and bending process. The fitting sleeve 1 has a cable-side end 2 opposite a connection-side end 3. Fitting sleeve 1 can be fitted in a fitting direction A onto other connector portions not shown in FIG. 1.

At a cable-side end 2 which is opposite a connection-side end 3, the fitting sleeve 1 has a tension relief system 4 which is constructed for receiving tensile forces which act on a cable. Tensile forces which occur are consequently transmitted to the fitting sleeve 1 and kept away from regions which are mechanically less stable. A retention element 50 of the fitting sleeve permits the fitting sleeve to be secured to a mating connector.

Figure 2:
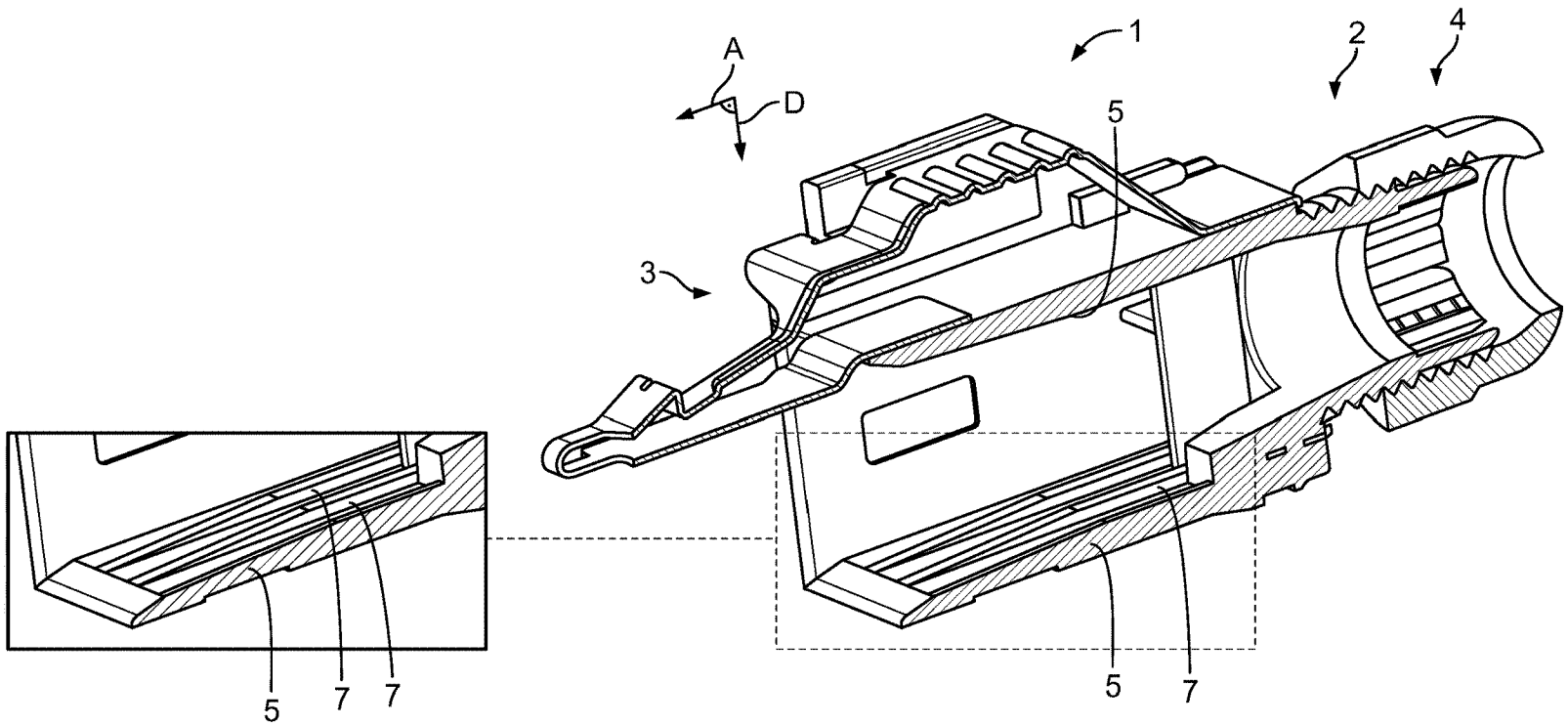
FIG. 2 is a sectioned perspective view of the fitting sleeve from FIG. 1 together with a detailed view.

As shown in FIG. 2, the upper and lower inner faces 5 of the fitting sleeve 1 extend towards each other counter to the fitting direction A. The space enclosed by the inner faces 5 is therefore wedge-like counter to the fitting direction A. The inner faces 5 of the fitting sleeve 1 are provided with grooves 7 in order to save material during the injection-moulding operation. The weight of the connector is also reduced thereby. Furthermore, the grooves 7 may act as guiding elements for additional connector portions.

Figure 11:
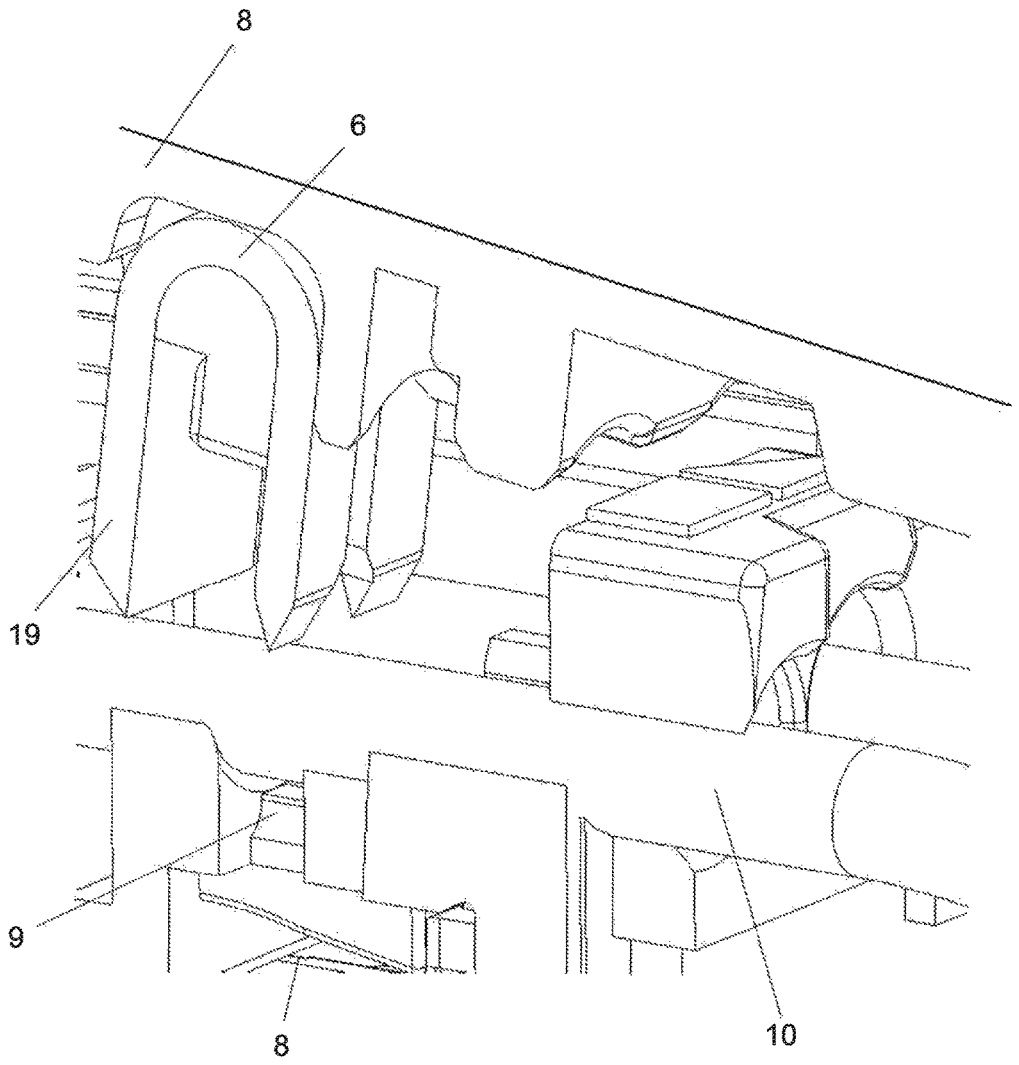
FIG. 11 is a detail view of the insulation displacement contact of FIG. 10, a cable, and a cable pressing face.

The plurality of connector portions 8 are shown in FIG. 6, and have a cable-side end 2 opposite a connection-side end 3. On the outer connector portions 8, shown folded outward in FIG. 4, there are arranged at the inner side insulation displacement contacts 6 which cooperate with cable pressing faces 9 on the central connector portion 8, as shown in FIG. 11. The outer connector portions 8 each have an outer face 12, a folding articulation 16 with an axle 15, and a slotted member 17 having longitudinal slots 18. The axles 15 are longitudinally disposed within and guided in a movable manner within longitudinal slots 18, thereby permitting pivoting motion of the outer connector portion 8 with respect to the central connector portion 8.

The connector portions 8 may be a metal formed from a metal sheet by a punching and bending process. Alternatively, the connector portions 8 may, for example, comprise a plastics material, and may be produced in an injection-moulding method.

Figure 10:
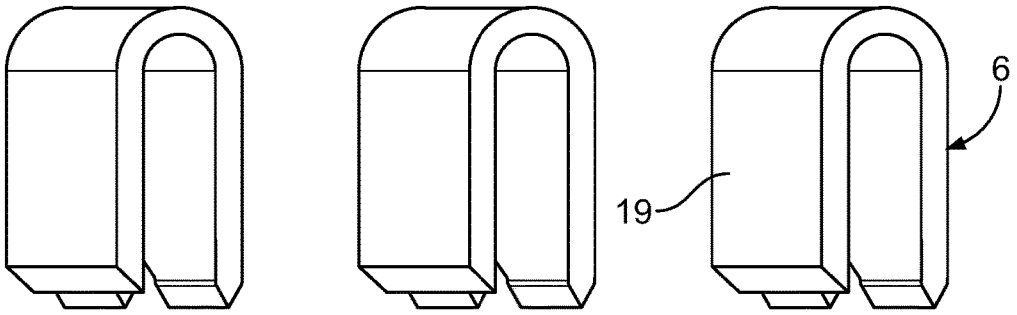
FIG. 10 is a perspective view of an insulation displacement contact and separation element according to the invention.

Insulation displacement contacts 6 are shown in FIG. 10. They are integral with the separation elements 19. Insulation displacement contact 6 may be a punched portion, which has been punched from a metal sheet and has been bent in a U-shaped manner. One member of the U acts as an insulation displacement contact 6, the other member acts as a separation element 19. The separation element 19 in this instance has a defined spacing with respect to the insulation displacement contact 6 so that the electrical properties in the connector which is produced are defined in a precise manner.

The cable 11 has a plurality of cable strands 10. The cable 11 may be any form of cable 11 with strands 10 known to those with ordinary skill in the art.

The assembly of the arrangement 14 for or in an electrical connector 20 will now be described. In FIGS. 3 to 9, the fitting sleeve 1 is shown together with additional connector portions during the assembly operation.

Figure 3:
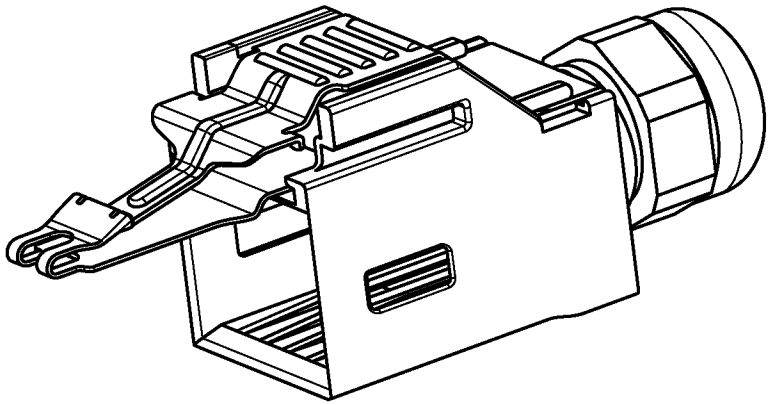
FIG. 3 is a perspective view of an arrangement according to the invention for an electrical connector in a first assembly step.
Figure 3:
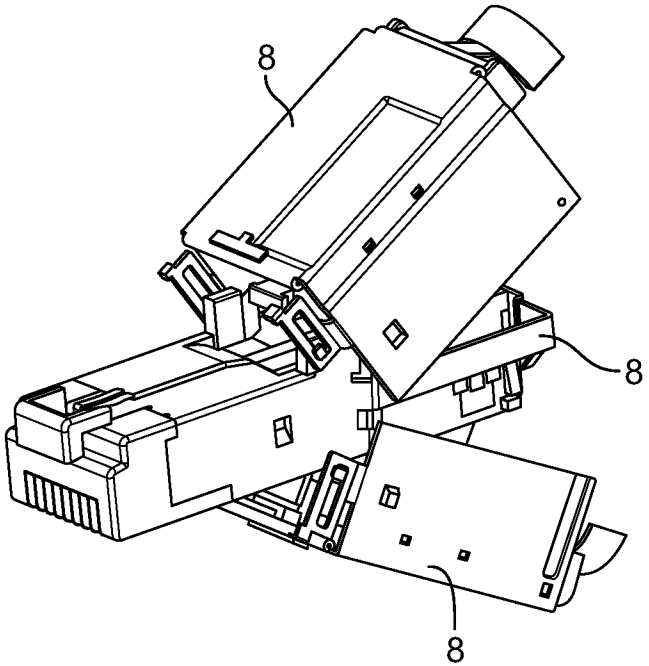

FIG. 3 shows a first assembly step in which the fitting sleeve 1 and plurality of connector portions 8 are in a pre-assembly position. The outer connector portions 8 are folded open in an outward direction.

Figure 4:
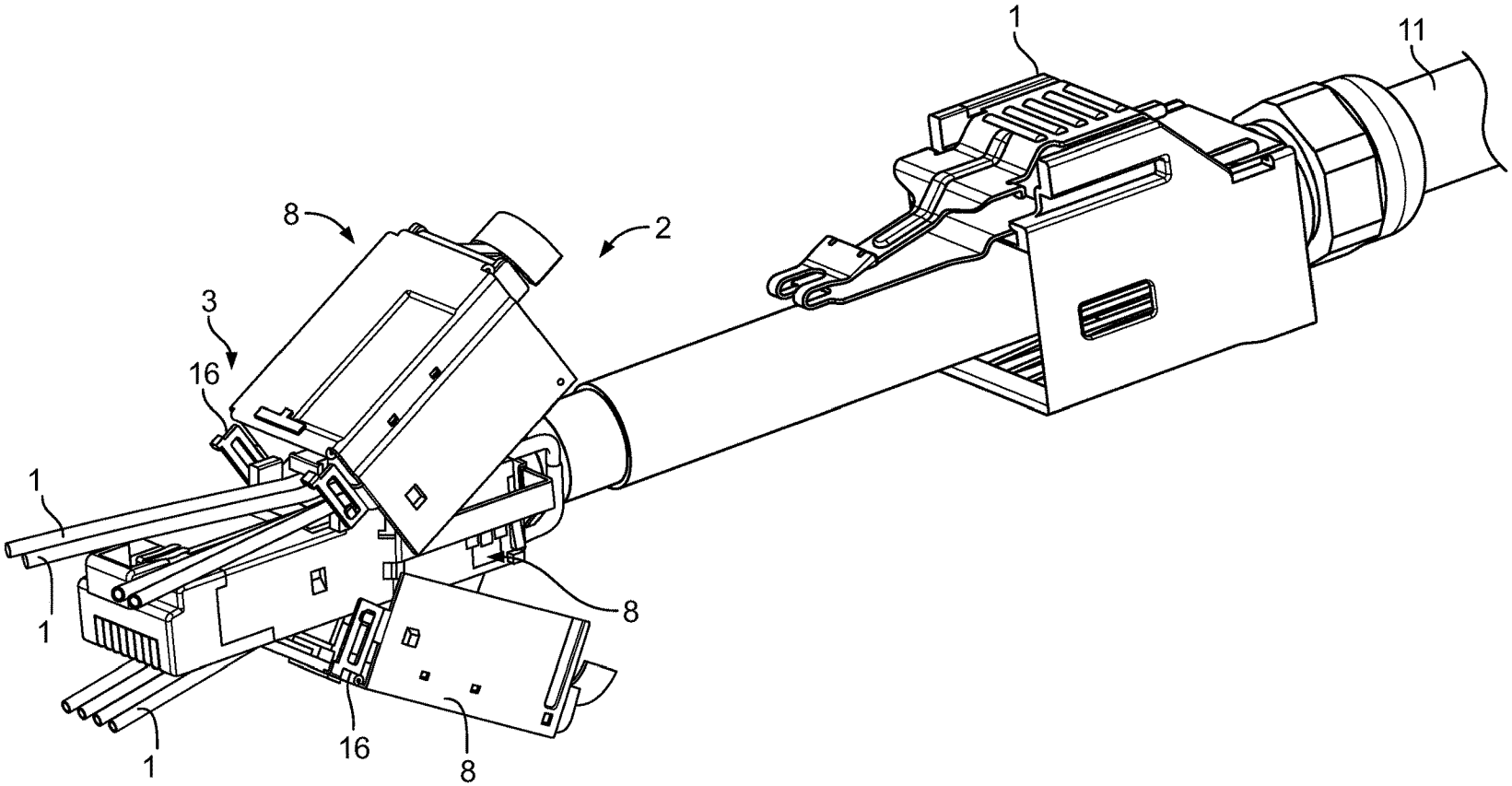
FIG. 4 is a perspective view of the arrangement of FIG. 3 in a second assembly step.

As shown in FIGS. 4 and 11, an entire cable 11 is then fitted through the fitting sleeve 1 and the cables 10 which constitute the strands of the entire cable 11 are each arranged between an insulation displacement contact 6 and a cable pressing face 9 of the central connector portion 8. Since the folding articulations 16 which are required for the folding movement are arranged at a connection-side end 3, the outer connector portions 8 at the cable-side end 2 can be folded open, whereby the cables 10 can be readily introduced.

Figure 5:
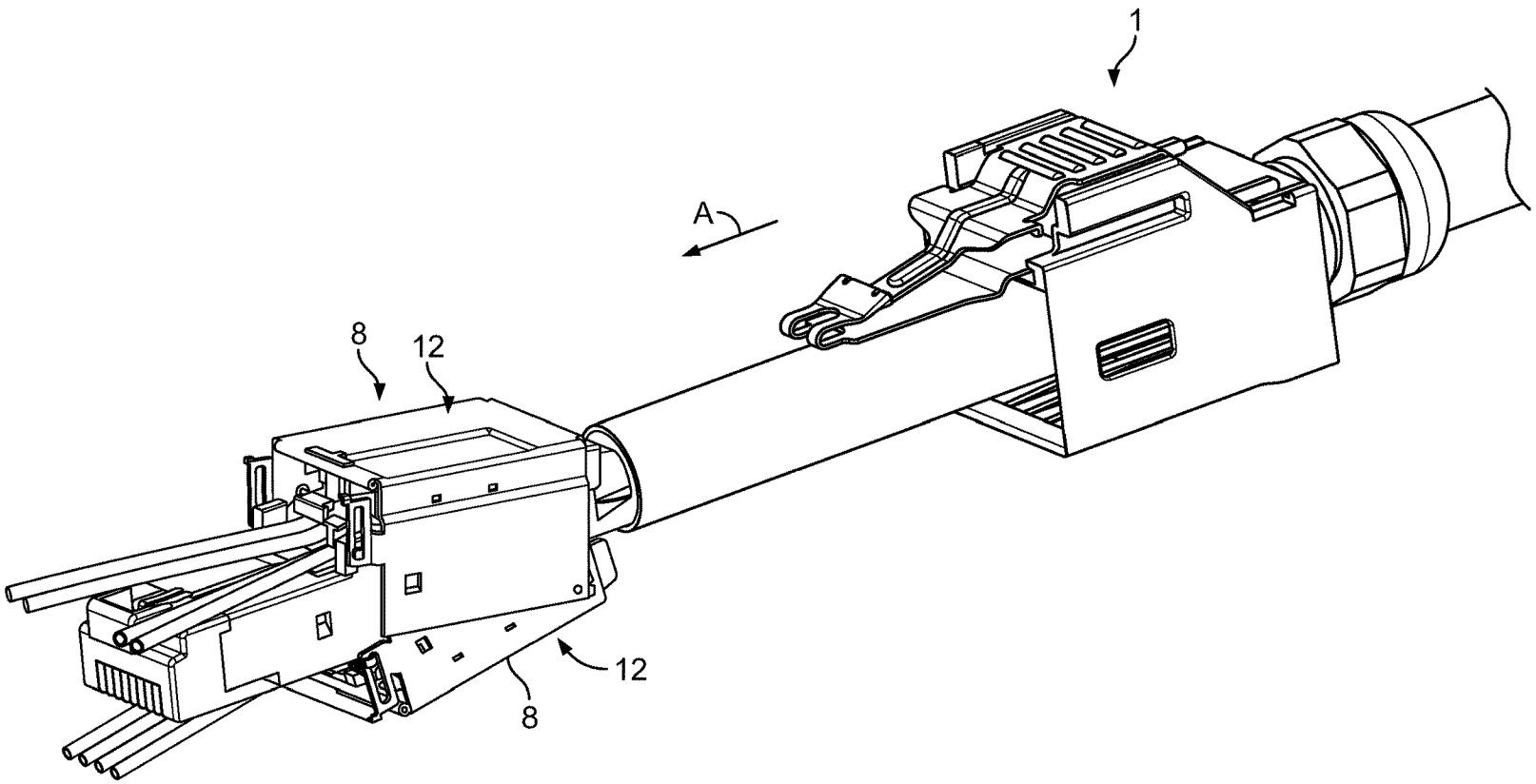
FIG. 5 is a perspective view of the arrangement of FIG. 3 in a third assembly step.

As shown in FIGS. 5 and 11, the lateral connector portions 8 are then folded onto the central connector portion 8 and the cables 10 are thereby securely clamped between the insulation displacement contacts 6 and the cable pressing faces 9. In this instance, the insulations of the cables 10 have not yet been completely cut through, but instead the cables 10 are only fixed in position. The outer connector portions 8 are in this instance slightly excessively pressed. The outer faces 12 of the outer connector portions 8 then extend towards each other counter to the fitting direction A. The portion of the connector formed by the two outer connector portions 8 thus tapers counter to the fitting direction A. It can thereby be pushed into the fitting sleeve 1.

FIG. 6 shows the arrangement 14 shortly before assembly. The angle which is formed by the two outer faces 12 is greater than 0 and less than 20 degrees; the angle in the embodiment shown in FIG. 6 is approximately 10 degrees. It is consequently greater than the angle between the inner faces 5 of the fitting sleeve 1 so that the two outer connector portions 8 are continuously pushed together over the entire length thereof. The force acting during the insulation displacement process is produced from the difference between the two angles. However, since the user applies a force in and counter to the fitting direction A, this force to be applied by the user, owing to the inclination of the oblique plane, is very much smaller than if the user had to apply the force directly in the pressing direction D perpendicularly relative to the fitting direction A.

The fitting sleeve 1 can be fitted from the cable-side end 2 onto the remainder of the connector. In particular, the user can take the entire cable 11 in one hand and the fitting sleeve 1 in the other hand and pull the fitting sleeve 1 onto the remainder of the connector with a pulling movement. Alternatively, the fitting sleeve 1 can also be fitted over the other connector portions 8 by means of a pressing movement.

Figure 7:
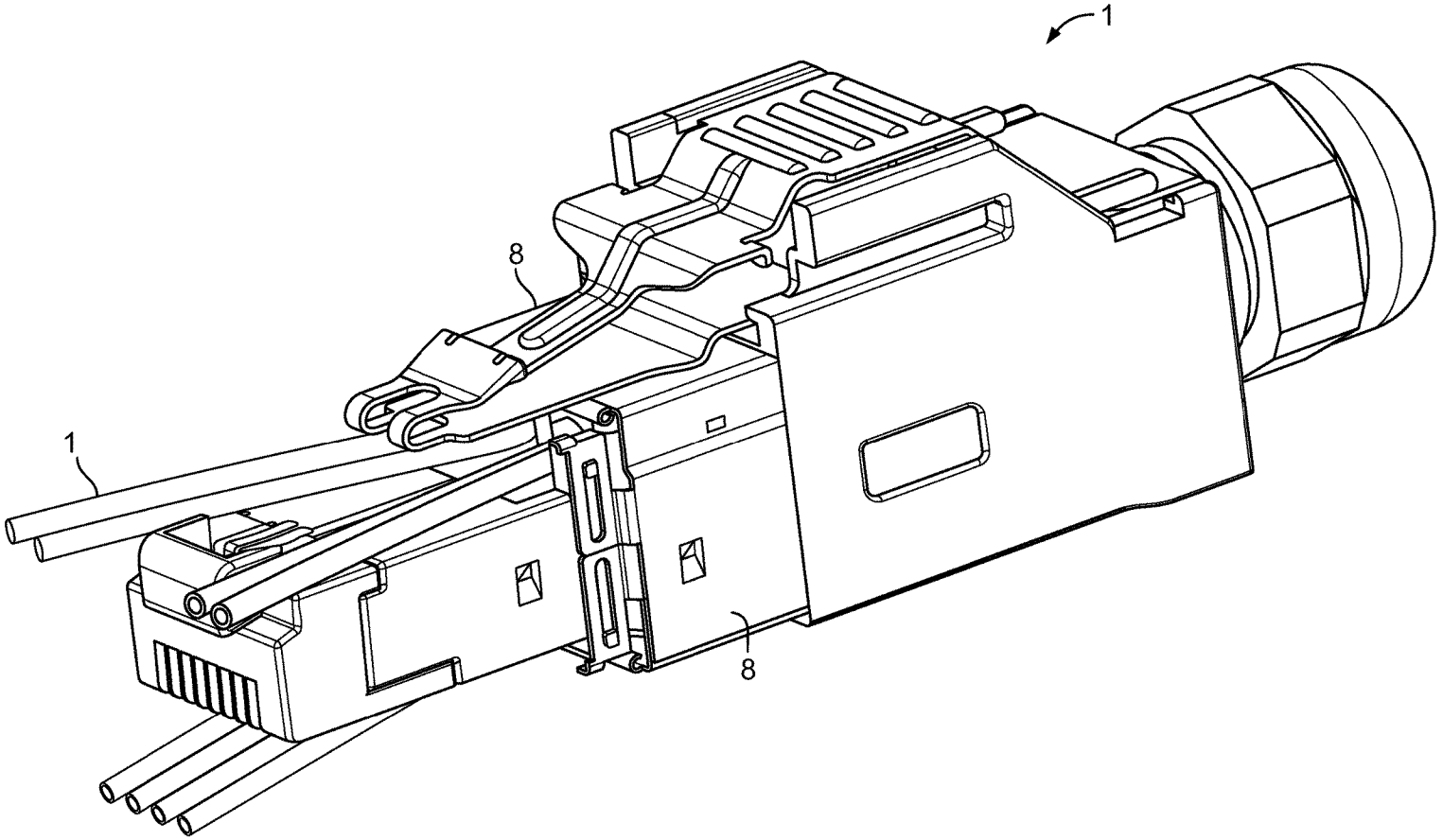
FIG. 7 is a perspective view of the arrangement of FIG. 3 in a fifth assembly step.
Figure 8:
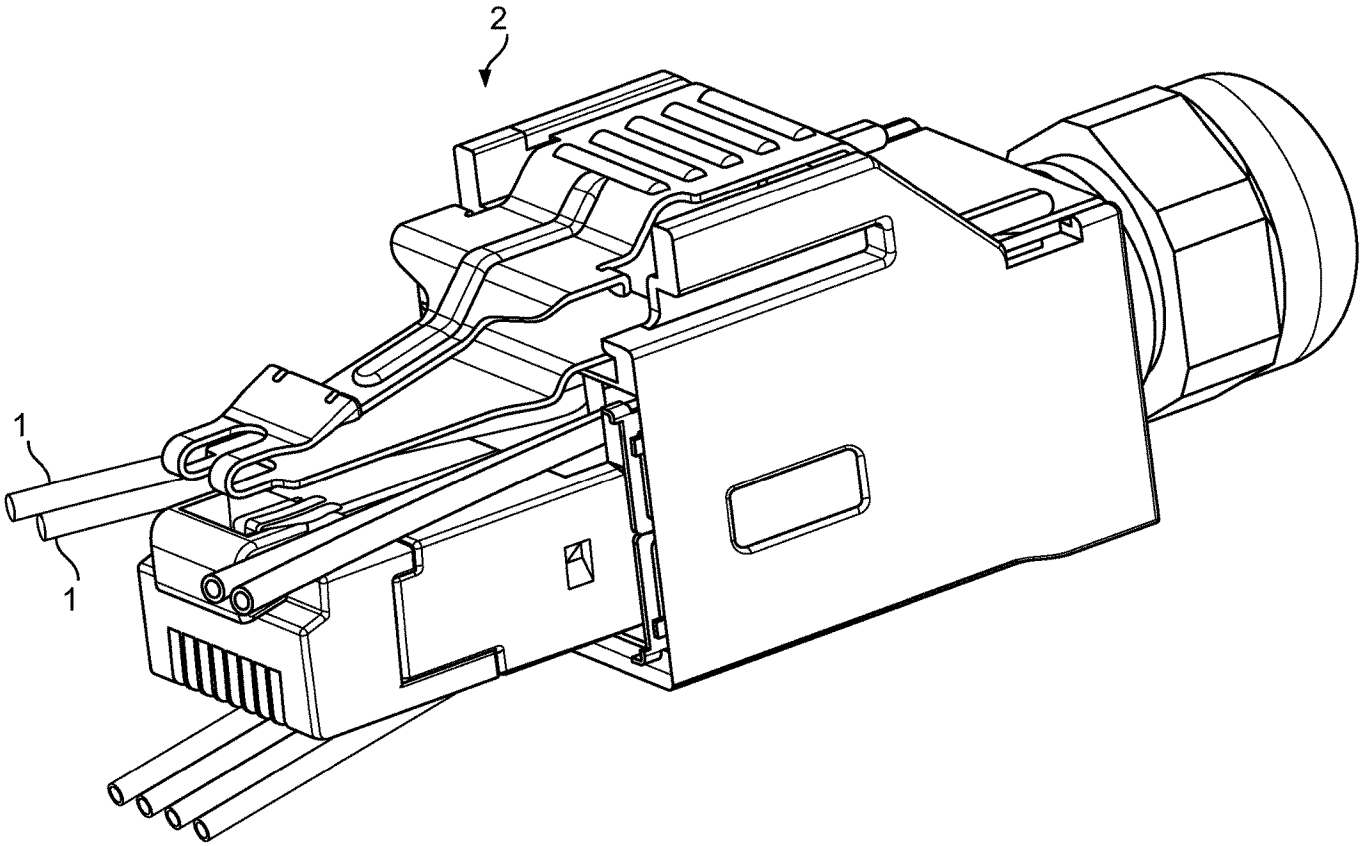
FIG. 8 is a perspective view of the arrangement of FIG. 3 in a sixth assembly step.

When the fitting sleeve 1 is fitted onto the plurality of connector portions 8, as shown in FIGS. 7 and 8, the connector portions 8 are automatically pressed together transversely relative to the fitting direction A in a pressing direction D. When the fitting sleeve 1 is fitted onto the remainder of the connector, the two outer connector portions 8 can be displaced in a linear manner relative to each other. The insulation displacement operation can thus be carried out in a linear manner. An insulation displacement contact 6 which is provided in the outer connector portions 8 is pressed onto a cable, which in turn is supported on a cable pressing face 9 of the central connector portion 8. The insulation displacement contact 6 cuts into an insulation of the cable 10 and produces an electrical contact with the conductive inner side of the cable 10. In this instance, the contact is automatically produced when the fitting sleeve 1 is fitted. Due to the forces which are increased by the lever action of the oblique plane, during the fitting operation a cable 10 can be both contacted by the insulation displacement contact 6 and separated by the separation element 19.

Figure 9:
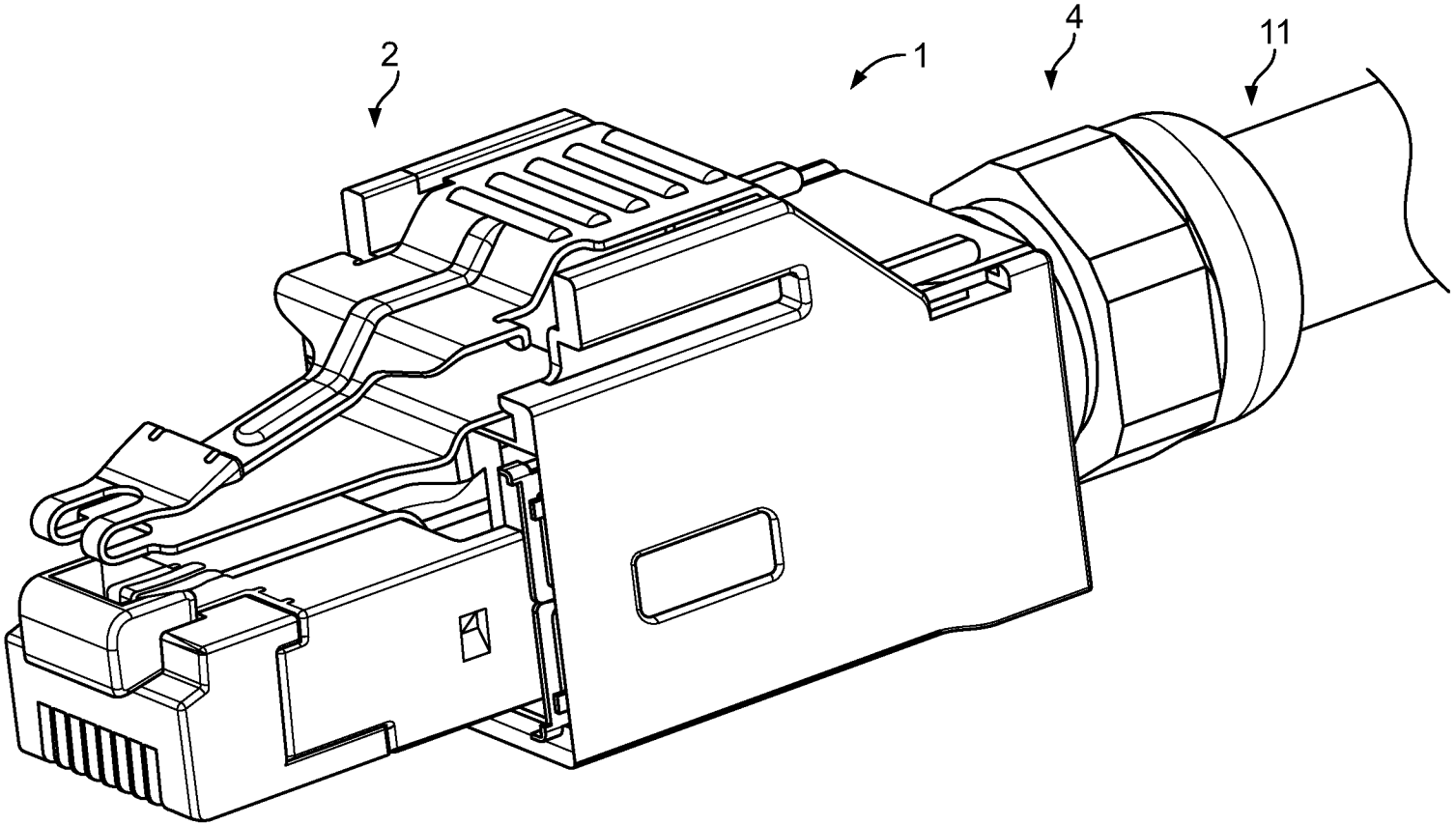
FIG. 9 is a perspective view of the arrangement of FIG. 3 in a seventh assembly step.

In FIG. 8, the connector 20 is illustrated in the completely assembled state. The separated portions of the cables 10 may still protrude at the connection-side end 2 of the connector 20 and can be readily removed, as shown in FIG. 9. In order to still fix the connector 20 to the entire cable 11 in a mechanically secure manner, the tension relief system 4 can be securely screwed.

Advantageously, since a contact is automatically produced when the fitting sleeve 1 is fitted on the plurality of connector portions 8, the forces which a user has to apply in order to produce the contact between the insulation displacement contacts 6 and cable 10 are smaller than when the insulation displacement contact 6 is pressed manually in the pressing direction D onto the cable 10. It is thereby possible to produce electrical connectors without the assistance of additional tools, for example, in situ in the event of a repair. Since the cable 10 can be both contacted by the insulation displacement contact 6 and separated by the separation element 19, the electrical properties, in particular the wave resistance and consequently the transmission properties, are well-defined. The combination of the entire cable 11 and the connector 20 is consequently suitable for high signal transmission rates.

What is claimed is:

1. An arrangement for an electrical connector, comprising:

a first connector portion and a second connector portion which can be folded relative to each other, the first connector portion having an insulation displacement contact and a first outer face, and the second connector portion having a cable pressing face facing the insulation displacement contact and a second outer face, each of the first and second connector portions having a folding articulation including a slotted member and an axle, the axle confined within the slotted member, longitudinally disposed within and guided in a movable manner within the slotted member, and the slotted member rotatable around the axle for permitting pivoting motion of the first connector portion with respect to the second connector portion;

a fitting sleeve having inner faces fitting over the first and second connector portions in a fitting direction, the inner faces extending towards each other counter to the fitting direction from a connection-side end of the fitting sleeve to a cable-side end of the fitting sleeve and forming an angle between the inner faces greater than 0 degrees, the first outer face and the second outer face extending away from each other in the fitting direction and extending towards each other counter to the fitting direction; and a cable extending through the fitting sleeve in the fitting direction from the cable-side end of the fitting sleeve to the connection-side end of the fitting sleeve and extending between the first connector portion and the second connector portion.

2. The arrangement of claim 1, wherein an angle between the first outer face and the second outer face is greater than 0 and less than 20 degrees.

3. The arrangement of claim 2, wherein the angle between the inner faces is less than 20 degrees.

4. The arrangement of claim 3, wherein the angle between the first outer face and the second outer face is greater than the angle between the inner faces.

5. The arrangement of claim 4, further comprising a separation element separating the cable.

6. The arrangement of claim 5, wherein the separation element is connected to the insulation displacement contact.

7. The arrangement of claim 6, wherein the separation element is arranged with a defined spacing relative to the insulation displacement contact.

8. The arrangement of claim 2, wherein the first connector portion is pivotally attached to the second connector portion at a connection-side end of each of the first and second connector portions.

9. The arrangement of claim 8, wherein the angle between the first outer face and the second outer face is formed at a cable-side end opposite the connection-side end of each of the first and second connector portions, the fitting direction extending from the cable-side end of each of the first and second connector portions toward the connection-side end of each of the first and second connector portions.

10. The arrangement of claim 1, wherein the folding articulation is arranged at a connection-side end of each of the first and second connector portions.

11. The arrangement of claim 1, wherein the inner faces are provided with grooves.

12. The arrangement of claim 11, wherein the fitting sleeve is fitted on a cable-side end of the first and second connector portions.

13. The arrangement of claim 1, wherein the fitting sleeve has a tension relief system.

14. The arrangement of claim 1, wherein the first connector portion and the second connector portion are inserted into the fitting sleeve counter to the fitting direction and the first connector portion and the second connector portion are progressively pushed together over an entire length of the fitting sleeve during insertion.

15. The arrangement of claim 1, wherein each of the first outer face and the second outer face is formed in a single plane.

16. An arrangement for an electrical connector, comprising:

a first connector portion and a second connector portion which can be folded relative to each other, the first connector portion having an insulation displacement contact and a first outer face, and the second connector portion having a cable pressing face facing the insulation displacement contact and a second outer face, each of the first and second connector portions having a folding articulation including a slotted member and an axle, the axle confined within the slotted member, longitudinally disposed within and guided in a movable manner within the slotted member, and the slotted member rotatable around the axle for permitting pivoting motion of the first connector portion with respect to the second connector portion;

a fitting sleeve having inner faces fitting over the first and second connector portions in a fitting direction, the inner faces extending towards each other counter to the fitting direction from a connection-side end of the fitting sleeve to a cable-side end of the fitting sleeve and forming an angle between the inner faces, the first outer face and the second outer face extend away from each other in the fitting direction and extend towards each other counter to the fitting direction, and an angle between the first outer face and the second outer face is greater than the angle between the inner faces; and a cable extending through the fitting sleeve in the fitting direction from the cable-side end of the fitting sleeve to the connection-side end of the fitting sleeve and extending between the first connector portion and the second connector portion.

17. The arrangement of claim 16, wherein the angle between the first outer face and the second outer face is greater than 0 and less than 20 degrees.

18. An arrangement for an electrical connector, comprising:

a first connector portion and a second connector portion which can be folded relative to each other, the first connector portion having an insulation displacement contact and the second connector portion having a cable pressing face facing the insulation displacement contact, each of the first and second connector portions having a folding articulation including a slotted member and an axle, the axle confined within the slotted member, longitudinally disposed within and guided in a movable manner within the slotted member, and the slotted member rotatable around the axle for permitting pivoting motion of the first connector portion with respect to the second connector portion; and a fitting sleeve having inner faces fitting over the first and second connector portions in a fitting direction, the inner faces extending towards each other counter to the fitting direction from a connection-side end of the fitting sleeve to a cable-side end of the fitting sleeve and forming an angle between the inner faces greater than 0 degrees.

19. The arrangement of claim 18, wherein the first connector portion and the second connector portion are pivotable and linearly displaceable relative to each other.

20. The arrangement of claim 18, wherein the axle and the slotted member are arranged at an end of each of the first and second connector portions further from the cable-side end of the fitting sleeve in the insertion direction.

* * * * *